United States Patent [19]

Lewis

[11] 4,073,399

[45] Feb. 14, 1978

[54] TEAR-OFF CLOSURE

[75] Inventor: Paul R. Lewis, Richmond, Ind.

[73] Assignee: Aluminum Company of America, Pittsburgh, Pa.

[21] Appl. No.: 661,254

[22] Filed: Feb. 25, 1976

[51] Int. Cl.[2] ..... B65D 41/42

[52] U.S. Cl. ..... 215/254; 215/253; 215/305; 215/256

[58] Field of Search ..... 215/253, 254, 255, 256, 215/304, 305; 220/270

[56] References Cited

U.S. PATENT DOCUMENTS

| | | | |
|---|---|---|---|
| 1,874,208 | 8/1932 | Reardon | 215/304 |
| 2,490,791 | 12/1949 | Erb | 215/305 |
| 3,216,602 | 11/1965 | Koll | 215/254 |
| 3,258,149 | 6/1966 | Wheaton | 215/254 |
| 3,596,790 | 8/1971 | Leftault | 215/254 |
| 3,865,268 | 2/1975 | Coop | 215/256 |
| 3,902,621 | 9/1975 | Hidding | 215/254 |
| 3,931,904 | 1/1976 | Coop | 215/254 |

FOREIGN PATENT DOCUMENTS

| | | | |
|---|---|---|---|
| 395,607 | 7/1933 | United Kingdom | 215/254 |
| 1,139,247 | 1/1969 | United Kingdom | 215/254 |

*Primary Examiner*—Ro E. Hart

*Attorney, Agent, or Firm*—William J. O'Rourke, Jr.

[57] ABSTRACT

An improved tear-off closure for a container comprising a top end wall, a depending closure skirt around the top end wall and a pull ring around the bottom edge of the closure skirt. The closure has a pair of score lines therein traversing the skirt and the top end wall to define a tear strip across the closure. The pull ring is integrally connected to the tear strip at the bottom of the closure skirt. A line of separation between the pull ring and the closure skirt extends from a location adjacent the score line on one side of the tear strip around the closure skirt to a location adjacent the score line on the other side of the tear strip. The curved terminal ends of the line of separation are spaced from the tear strip laterally of the score lines on both sides of the tear strip.

5 Claims, 15 Drawing Figures

TEAR-OFF CLOSURE

BACKGROUND OF THE INVENTION

1. Field of Invention

The present invention relates to a container closure and more particularly to an improved tear-off closure having an integral, concentric pull ring for manually removing the closure from a container on which it is sealed.

2. Description of the Prior Art

The well-known crown seal closure for beverage bottles has been in use since the late nineteenth century. Since the only practical method of removing the crown seal bottle cap is with an auxiliary tool such as the conventional bottle opener, there have been many efforts to design a bottle cap which does not require such tools. One result of such efforts was the development of twist-off or screw-off closures. In order to employ these screw-off closures, the exterior surface of the bottle mouth must have a threaded finish for securing the screw-off closure on the bottle.

Some ecology oriented groups are demanding the use of returnable beverage bottles as an ecological attempt to reduce the quantity of unsightly litter. A few jurisdictions have also enacted legislation which encourages use of returnable bottles. Approximately two-thirds of the existing returnable beverage bottles have crowned rather than threaded finishes. With approximately forty billion crown seal bottles in circulation today, an easily removable replacement for the crown seal bottle cap is desirable.

A tear-off closure having an integral, concentric pull ring for removing the closure from the container is discloseed in Coop U.S. Pat. No. 3,865,268. The cap wall of that closure terminates in a bead and has a sever line between the bead and cap wall to enable severing of a major portion of the bead from the closure during capping. The severed bead forms a pull ring for pulling the closure from the container. The unsevered portion of the bead integrally connects the pull ring to the cap wall. In such cap, the sever line intersects with a pair of score lines formed on the closure defining a tear strip which is easily severed from the cap when the ring is pulled upwardly.

The score lines that define the tear strip in the body of the closure of U.S. Pat. No. 3,865,268 are preferably formed in the flat blank before the blank is drawn into a cup shape. The sever line which defines the pull ring is formed after drawing the blank into the cup shape. Utilizing such two step process makes it difficult to perfectly align the sever line with the score lines such that the terminal ends coincide. If the sever line is out of alignment such that it terminates inwardly of the score lines inside the tear strip, the pull ring may be torn from the tear strip when attempting to remove the closure.

Intersection of the sever line with both score lines in the thin cap wall of the closure of U.S. Pat. No. 3,865,268 may also cause the closure to be weak at such points of intersection. The impace of such weakness is apparent when considering that beer and other beverages, especially carbonated beverages, may exert a force in excess of ninety pounds per square inch against the under surface of the applied bottle cap. Such pressure may effect premature rupturing of the tear strip of the closure at the points where the sever line intersects the score lines of the tear strip.

Accordingly, an improved tear-off closure is desired which will assure that after the capping operation, the closure is able to withstand high internal pressures while maintaining the advantage of being relatively easy to open manually without need for a bottle opener.

SUMMARY OF THE INVENTION

This invention may be summarized as providing an improved tear-off closure for a container comprising a top end wall, a depending skirt wround the top end wall and a pull ring around the bottom edge of the closure skirt. In the broad aspects of this invention, the closure has a pair of score lines therein traversing the skirt and top end wall to define a tear strip therebetween across the closure, with a pull ring integrally connected to the tear strip at the bottom of the closure skirt. A line of separation between the pull ring and the closure skirt extends from a location adjacent the score line on one side of the tear strip around the closure skirt to a location adjacent the score line on the other side of the tear strip. The terminal ends of the line of separation are spaced from the tear strip laterally of the score lines on both sides of the tear strip.

Among the advantages of the subject invention is the provision of a new and improved tear-off closure, having an integral, concentric pull ring for removing the closure from the container, which is able to withstand the internal pressure caused by the gases which emanate from the liquid in the capped container.

This invention also simplifies manufacture of the closure by obviating any need to align the ends of the sever line with the score lines defining the tear strip.

It follows that an objective of this invention is the provision of an improved tear-off closue, having an integral, concentric pull ring for removing the closure from the container, which will resist premature rupture of the tear strip.

The above and other objects and advantages of this invention will be more fully understood and appreciated with reference to the following description and the drawings appended hereto.

DESCRIPTION OF THE PREFERRED EMBODIMENTS

Figure 1:
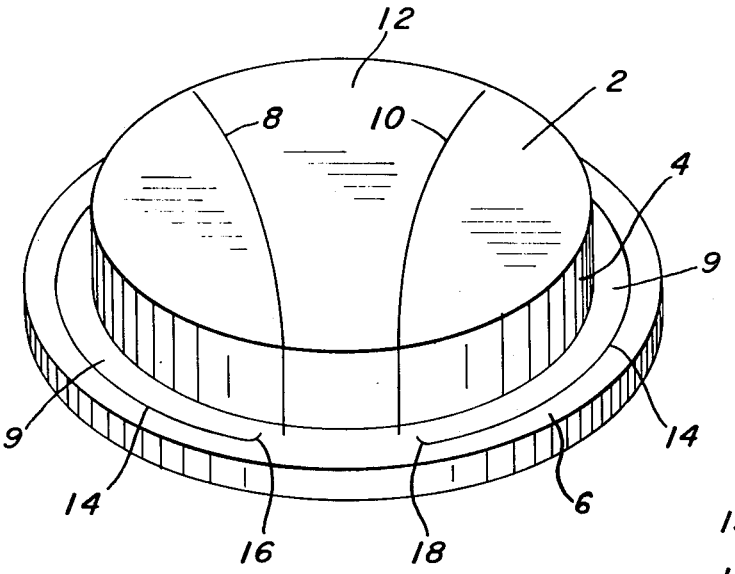
FIG. 1 is a perspective view of an improved tear-off closure of the present invention.

Referring particularly to the drawings, FIG. 1 illustrates an improved tear-off closure of this invention. The generally cup sahped closure includes a circular top end wall 2, a depending closure skirt 4 around the top end wall and an integral pull ring 6 around the skirt 4. A pair of score lines 8 and 10 extend from adjacent points on the depending skirt 4 immediately above the pull ring 6 across the closure skirt 4 and the top end wall 2 to define a tear strip 12 therebetween. The score lines 8 and 10 terminate at or near the junction of the top end wall 2 and the closure skirt 4.

The pull ring 6 comprises a curled bead around the periphery of the closure skirt 4 and is integrally connected to the base of the tear strip 12 at the bottom portion of the closure skirt 4. A line of separation 14 extends from a location adjacent the score line 8 on one side of the tear strip 12 around the closure skirt 4 to a location adjacent the other score line 10 on the other side of the tear strip 12. This line of separation 14 around the bottom of the closure skirt 4 separates the pull ring 6 from the closure skirt 4. In a preferred embodiment of a tear-off closure of this invention particularly adapted to be applied to a conventional crowned beer or beverage bottle having approximately a one inch diameter orifice, the distance between the terminal end 16 or 18 of the line of separation and the nearest score line 8 or 10 is approximately 0.030 to 0.040 inch.

In a preferred embodiment of this invention, the line of separation 14 comprises a line along which the metal in the closure is cut through except for possibly a couple of narrow bridges 13 of metal which connect the pull ring 6 to the closure skirt 4. In such embodiment the pull ring 6 is held in its proper position on the closure by entrapment of the bottom terminal edge of the closure skirt 4 in the curled bead which forms the pull ring 6 as will be described. The bridges 13 are useful primarily during the forming operations as will also be explained, but may also help to hold the pull ring 6 in its proper position on the closure after the closure has been formed.

In another embodiment of a closure of this invention, the line of separation 14 between the pull ring 6 and the closure skirt 4 may comprise a score line in which the metal in the closure is only partially cut through. Such a line of separation or sever line is illustrated and described in U.S. Pat. No. 3,865,268.

It is a feature of this invention that the terminal ends 16 and 18 of the line of separation 14, as seen in FIG. 1, are spaced from the score lines 8 and 10 which define the tear strip 12. This leaves a bridge of unscored or unweakened metal between both ends of the line of separation 14 and the tear strip 12. The unweakened metal helps prevent accidental rupture of the score lines 8 and 10 as can otherwise occur either during sealing of the closure on a container or when the sealed container holds relatively high internal pressures as frequently occurs with bottles of beer and carbonated beverages. If the line of separation 14 were to intersect the score lines 8 and 10 which define the tear strip 12, as does the sever line in Coop U.S. Pat. No. 3,865,268, the closure would be more vulnerable to accidental opening.

Figure 3:
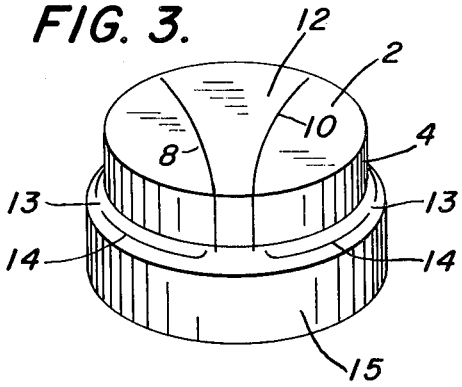
FIG. 3 is a perspective view of a closure of the present invention drawn into a general cup shape from a blank as shown in FIG. 2.
Figure 11:
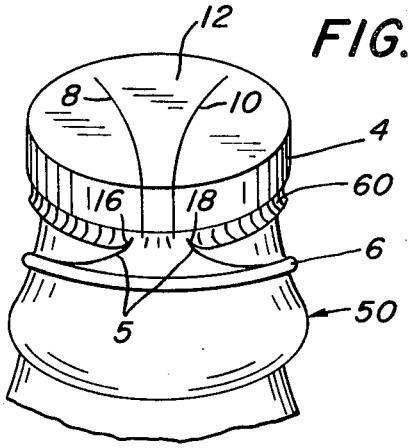
FIG. 11 is a perspective view of an improved tear-off closure of the present invention after application to a container.

The terminal ends 16 and 18 of the line of separation 14 in a preferred embodiment of the present invention are also curved inwardly and upwardly with respect to the closure skirt 4 in the direction of but not touching the score lines 8 and 10. The purpose and benefit of such curved terminal ends 16 and 18, as illustrated in FIGS. 1, 3 and 11, will be later explained in the description of the operation of the improved tear-off closure of this invention.

Figure 2:
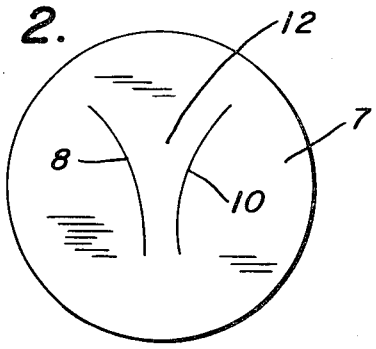
FIG. 2 is a plan view of a scored blank from which the closure of the present invention is formed.

A preferred method of forming the tear-off closure of this invention beings by cutting score lines 8 and 10 in light gauge sheet metal such as CH14 aluminum alloy in an extra hard temper (H19) at 0.0090 inch gauge, and then cutting or blanking a circular disc 7 from the sheet metal with the score lines 8 and 10 therein, as illustrated in FIG. 2. The score lines 8 and 10 define a tear strip 12 in the closure which will be formed from the disc 7. To facilitate severance of such tear strip 12, the score lines 8 and 10 are preferably formed so as to run substantially parallel with the grain of the metal disc 7. In a preferred embodiment, the score lines 8 and 10 each have an arc shape and diverge or draw apart from the ends thereof which will be adjacent the pull ring 6 in the formed closure to the other ends thereof which will be in the top end wall 2 of the formed closure as seen in FIG. 1. The narrowest width of the tear strip 12 defined by such score lines 8 and 10 is preferably adjacent the beaded pull ring 6.

Figure 4:
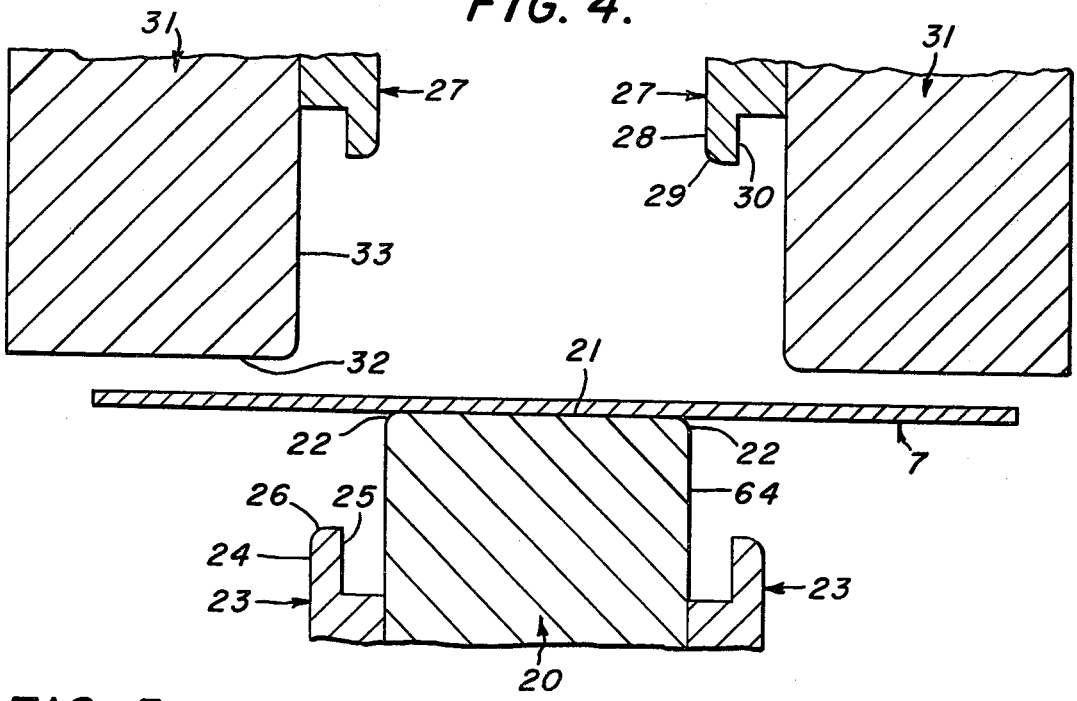
FIG. 4 is an enlarged cross-sectional view through dies for forming a cut blank into a generally cup shape.
Figure 5:
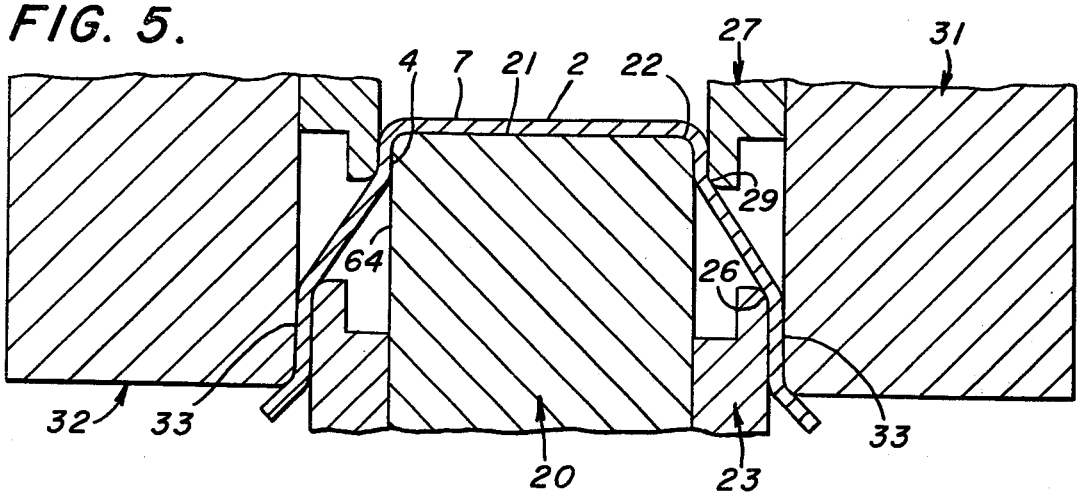
FIG. 5 is a cross-sectional view similar to FIG. 4 with the generally cup shape partially formed.
Figure 6:
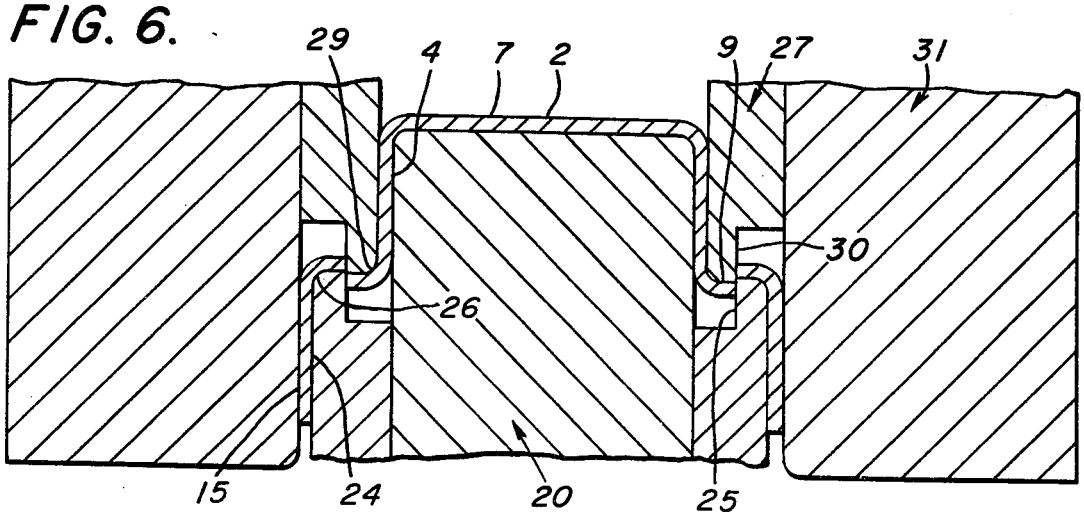
FIG. 6 is a cross-sectional view similar to FIGS. 4 and 5 showing completion of the generally cup shape.

The closure of this invention is preferably formed from disc 7 in two stages. FIGS. 4, 5 and 6 illustrate exemplary opposing upper and lower dies which are employed in the first state of drawing and forming the circular metal blank 7 into a generally cup shape and cutting a line of separation 14 therein. The lower dies include a first circular die member 20 with a planar top surface 21, a rounded outer corner surface 22 and an outwardly facing surface 64. Around the circular die member 20 is a die ring 23 having an outwardly facing shaping surface 24 extending through a rounded corner 26 and terminating at an inwardly facing shearing surface 25. The bottom die member 20 and the die ring 23 are held in fixed position for forming the blank 7 against the upper punch members.

The upper dies include a shear ring 27 having an inwardly facing shaping surface 28 extending through a rounded corner 29 and terminating at an outwardly facing shearing surface 30. Around the shear ring 27 is a punch ring 31 having a generally planar downwardly facing base surface 32, and an inwardly facing wall surface 33. While it would be understood by those skilled in the art that either the shear ring 27 or the punch ring 31, or both, may be spring loaded, in the preferred embodiment, they are solidly held in the upper die and remain stationary with respect to each other throughout the forming operation.

The upper dies are adapted to be moved toward the lower dies with the outwardly facing surface 64 of the circular die member 20 mating with the inwardly facing shaping surface 28 of the shear ring 27, and the outwardly facing shearing surface 30 of the shear ring 27 mating with the inwardly facing shearing surface 25 of the die ring 23. Additionally, the outwardly facing shaping surface 24 of the die ring 23 is adapted to mate with the inwardly facing wall surface 33 of the punch ring 31.

FIG. 5 illustrates an intermediate position of the dies during forming of the circular metal blank 7 into a generally cup shape which is to be subsequently formed into a tear-off closure of this invention. During closing of the dies as by downward travel of the upper dies to the position illustrated in FIG. 5, the base surface 32 of the punch ring 31 engages the outer peripheral portion of the metal disc 7 and bends such other portion over the rounded corner 22 and against the surface 64 of the circular die member 20. With further closing of the dies, the punch ring 31 bends or forms the peripheral edge of the metal disc 7 over the rounded corner 26 of the die ring 23, and the rounded corner 29 of the shear ring 27 engages the metal disc 7 to draw the metal tightly around the corner 22 on the bottom die member 20. This shapes the top end wall 2 of the closure to correspond with the planar top surface 21 of the die member 20 and begins to form the closure skirt 4. To permit such drawing, a clearance of slightly more than the thickness of the metal disc is provided between the inwardly facing shaping surface 28 and the outwardly facing surface 64 on the die member 20.

At the completion of the downward travel of the upper dies, the conjoint action of the shearing surface 30 of shear ring 27 and the shearing surface 25 of die ring 23 shears or cuts the metal in the wall 9 along the line of the shearing surfaces. This shear line around the periphery of the cup shape closure in the wall 9 defines the line of separation 14 in the closure. The line of separation 14 preferably does not extend completely around the bottom of the closure skirt 4. Rather, the line of separation 14 extends from a location adjacent the score line 8 on one side of the tear strip 12 around the closure skirt 4 to a location adjacent the other score line 10 on the other side of the tear strip 12, as shown in FIG. 3. In a preferred embodiment the line of separation 14 is also interrupted by one or more bridges of metal 13 as also shown in FIG. 3. To avoid shearing the metal in the tear strip and the bridges 13, the corresponding sharp edges of the shearing surfaces 25 and 30 are interrupted or machined off where the bridges 13 and the tear strip 12 are to be located such that complete shearing will not occur at such locations when the upper dies have completed their downward travel. The unscored metal in the bridges 13 in conjunction with the unscored metal in the tear strip 12 insures that the depending wall 15 is held in position on the closure skirt 4 to facilitate efficient handling of the closure prior to curling the bead in the second formation stage. In the absence of the bridges 13, the bottom portion of the closure would be loosely connected to the closure which would make it difficult to position the formed cup in the next set of dies.

To remove the formed cup from the dies, holes, not shown, may be provided through the circular die member 20, terminating at its top surface 21 for discharge of spurts of air therethrough to blow the closure out of the open dies. It shoud be understood by those skilled in the art that knockout dies may also be utilized to remove the closure.

Figure 7:
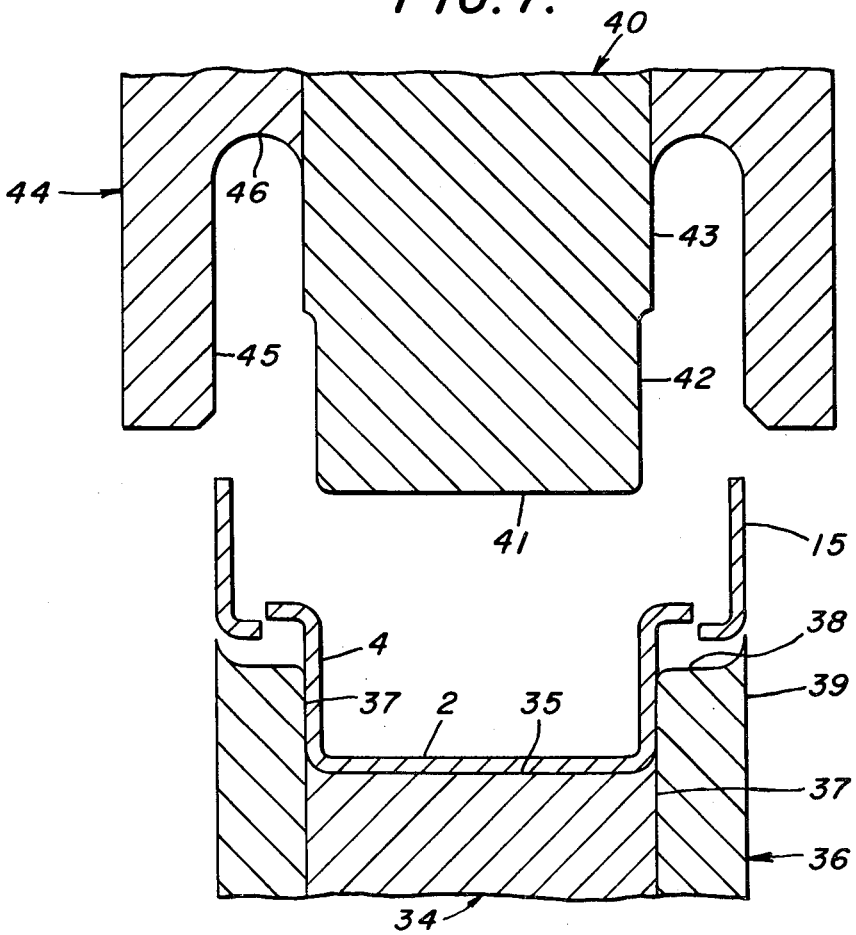
FIG. 7 is an enlarged cross-sectional view through dies for forming a pull ring on the generally cup shape closure shown in FIG. 6.
Figure 8:
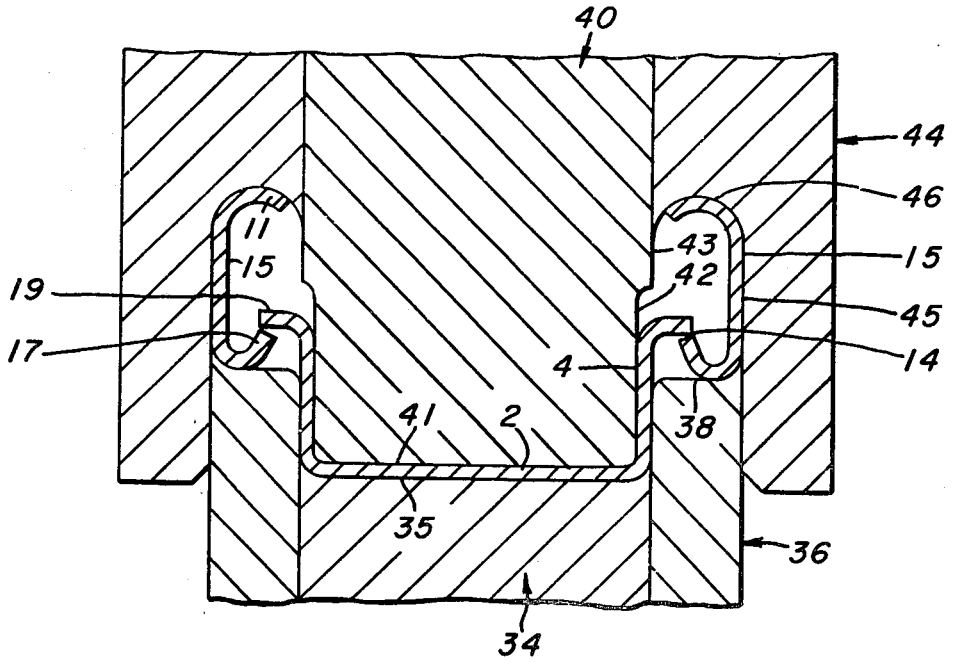
FIG. 8 is a cross-sectional view similar to FIG. 7 with the pull ring partially formed.
Figure 9:
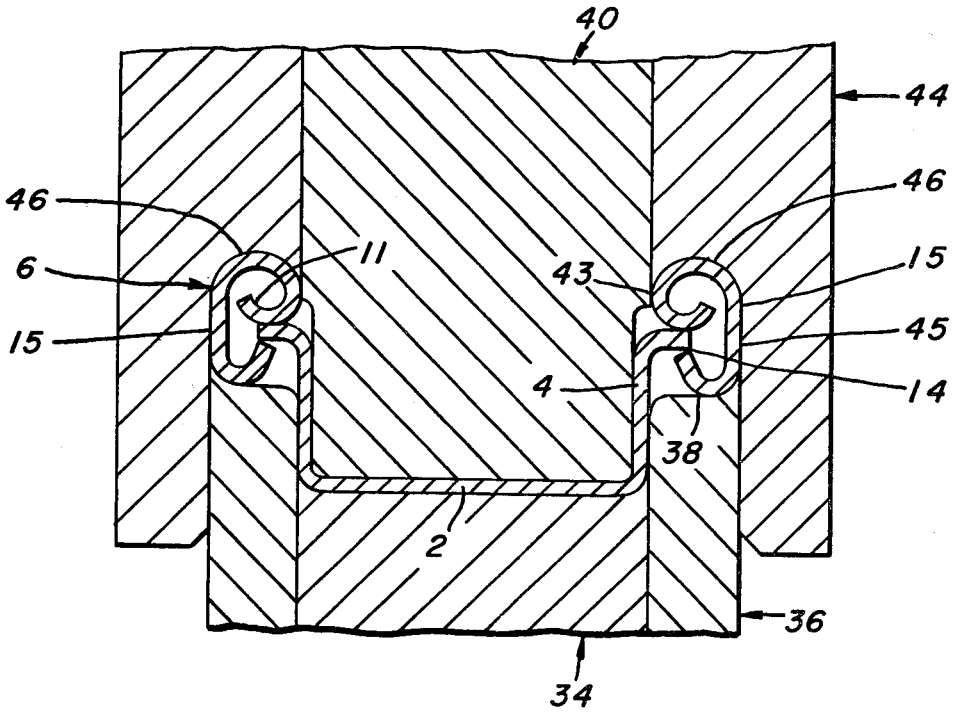
FIG. 9 is a cross-sectional view similar to FIGS. 7 and 8 showing completion of the pull ring.

FIGS. 7, 8 and 9 illustrate exemplary opposing dies which are employed in forming a pull ring 6 around the bottom of the closure skirt 4. As shown in FIG. 7, the lower dies include a circular knockout tool 34 with an upwardly facing top surface 35 conforming with the outside surface of the top end wall 2 of the closure. Around the knockout tool 34 is a support ring 36 having a circular inside wall 37 with a diameter substantially corresponding to the outside diameter of the closure skirt 4. The support ring 36 further has a curling surface 38 and an outside wall 39. The support ring 36 is preferably stationary or fixed while the knockout tool 34 is supported by springs or the like, not shown, so it can move downwardly in response to an upper die member moved thereagainst, and also spring upwardly to eject the closure out from dies when they are opened after completion of the forming operation.

The upper dies include a circular punch insert 40 having a downwardly facing base surface 41 conforming with the inside surface of the top end wall 2 of the closure. The punch insert further has a first wall surface 42 having a diameter substantially corresponding to the inside diameter of the closure skirt 4 and a height preferably slightly greater than that of the closure skirt 4. The first wall surface 42 of the punch insert 40 preferably terminates at a second wall surface 43 having a diameter substantially corresponding to the outside diameter of the closure skirt 4. Around the punch insert 40 is a curling ring 44 having a generally planar inside wall 45 which mates with the outside diameter of the depending skirt 15 of the closure and the outside wall 39 of the support ring 36 when the upper dies are subsequently lowered. The inside wall 45 of the curling ring 44 terminates at generally arc shaped curling surface 46.

As illustrated in FIG. 7, the closure has been inverted or turned upside down from its position in the first stage of formation shown in FIGS. 4, 5 and 6 such that the top end wall 2 of the closure is downwardly facing and is seated on the knockout tool 34 with the closure skirt 4 seated within a portion of the inside wall 37 of the support ring 36 which projects above the top surface 35 of the knockout tool 34. The reason for inverting the closure in the dies of FIG. 7 is for ease in transporting and properly seating the cup shaped closure inside a mating recess defined by the lower dies.

FIG. 8 illustrates an intermediate step in forming the concentric pull ring 6 on the closure. During die travel to the position illustrated in FIG. 8, the base surface 41 of the punch insert 40 first engages the inside surface of the top end wall 2 of the closure. Further downward travel of the upper dies causes the spring loaded knockout tool 34 and likewise the closure to be driven downwardly with respect to the ring 36 until the inside shell of the closure defined by the top end wall 2 and the closure skirt 4 engages the curling surface 38 of the stationary support ring 36. From that point to completion of the formation of the pull ring 6, only the curling ring 44 moves while the other dies remain relatively stationary. As the curling ring 44 proceeds in a downward direction, the inside surface 45 will define the outermost diameter of the pull ring 6 to be formed. As the terminal edge 11 of the wall 15 of the closure is engaged by the curling surface 46 on the curling ring 44, such edge 11 is reformed or curled to conform with the configuration of the curling surface 46.

Substantially simultaneously with the initial curling of the peripheral edge 11 of the wall 15 the opposite end 17 of the wall 15 immediately adjacent the line of separation 14 in the closure is forced downwardly into and reformed by the curling surface 38 of the support ring 36. Continued downward travel of the curling ring 44 drives the edge 17 of the wall 15 defining the line of separation 14 into engagement with the corresponding edge 19 of the closure skirt 4 also defining the line of separation to effectively prevent further curling of the end of the wall 15 adjacent the line of separation 14.

It should be understood that any bridges 13 of metal or interruptions in the line of separation 14 may be severed during the curling of the depending wall 15. However, as is explained below, the curling may result in entrapment of the edge 19 of the closure skirt 4 inside a slot in the concentric pull ring 6 which performs the same function as the bridges 13.

FIG. 9 illustrates the completion of forming an integral concentric pull ring 6 at the base of the closure skirt 4. As the curling ring 44 proceeds downwardly to the position shown in FIG. 9, the outer peripheral edge 11 of the wall 15 continues to follow the contour of the curling surface 46 until it engages the second wall surface 43 of the punch insert 40. Further downward travel of the curling ring 44 curls the peripheral edge 11 of the wall 15 inwardly upon and along the edge 19 of the closure at the base of the closure skirt 4. The conjoint compression of both ends of the curled depending wall 15 against the edge 19 at the base of the closure skirt 4 thereby entraps the edge 19 of the closure skirt 4 within the formed pull ring 6. Also, the curling of the edges 15 and 17 has another important function of not cutting the fingers of the consumer during opening of the closure.

After the pull ring 6 is formed the dies are opened and the spring loaded knockout tool 34 ejects the closure from between the dies.

Figure 13:
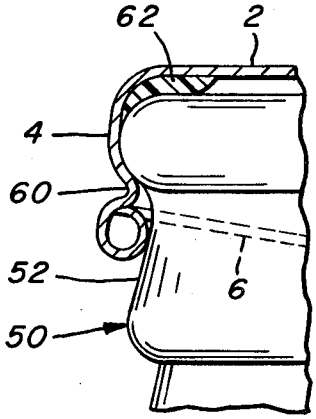
FIG. 13 is a portion of a cross-sectional view of an improved tear-off closure of the present invention after its application to the container.
Figure 14:
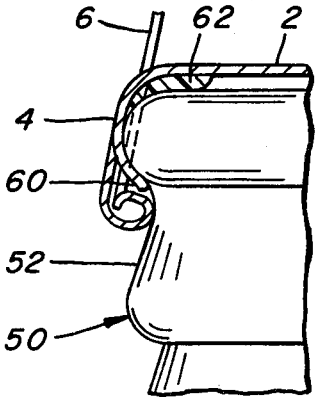
FIG. 14 is a portion of a cross-sectional view of an improved tear-off closure of the present invention after its application to the container showing the pull ring in the lifted position.

After the closure has been formed, a liner such as the plastisol liner 62 shown in FIGS. 13 and 14, is adhesively applied to the interior portion of the tear-off closure at the junction between the closure skirt 4 and the top end wall 2. The liner 62 is adapted to be compressed against the mouth of the container on which the closure is sealed to assure that a tight seal is provided on the capped container.

Figure 10:
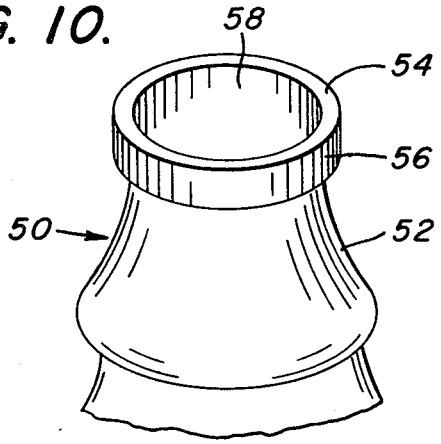
FIG. 10 is a perspective view of the top portion of a conventional crown finish container to which an improved tear-off closure of the present invention may be applied.

FIG. 10 illustrates a conventional crowned container 50 to which the tear-off closure of this invention is designed to be applied. The container 50 shown in FIG. 10 has a crown 52 and a mouth 58 with a bead 56 therearound for securing a closure over the mouth 58. There is a generally flat rim 54 around the top of the bead 56 with the inside of the rim 54 defining the circumference of the mouth opening 58 in the container 50.

FIG. 11 illustrates an improved tear-off closure of this invention after it has been applied to the container 40. In the capping operation the tear-off closure, as shown in FIG. 1, is placed over the container mouth 58 of the container 50 shown in FIG. 10, such that the plastisol liner 62 applied to the inside surface of the top end wall 2 rests on the rim 54 of the container 50. The closure skirt 4 extends downwardly around the outside portion of the container bead 56. Capping is effected by constricting the bottom edge portion 60 of the closure skirt 4 in such a manner that the bottom edge portion 60 is turned inwardly under and against an annular outwardly projecting container bead 56 around the entire periphery of the container mouth 58.

As a result of the inward constriction of the bottom edge 60 of the closure skirt 5, the pull ring 6 is separated from the bottom edge 19 of the closure skirt 4 along the line of separation 14. The pull ring 6, however, remains integrally attached to the closure skirt 4 at the base of the tear strip 12 even though the constriction of the bottom edge 60 of the closure skirt 4 extends through this connection.

Figure 12:
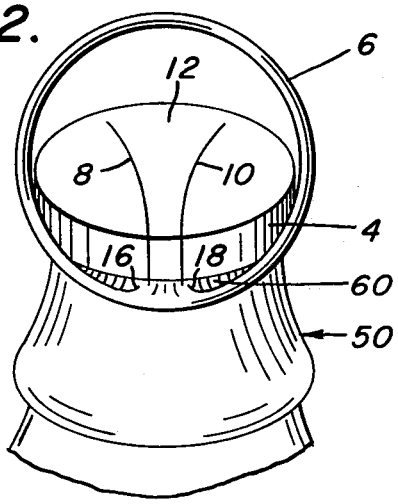
FIG. 12 is a perspective view of an improved tear-off closure of the present invention after its application to a container showing the pull ring with its free end in the lifted position.

To gain access to the contents of a container 50 having a tear-off closure of this invetion applied thereto, the free end of the pull ring 6 is lifted over the closure skirt 4 and the top wall 2 as shown in FIG. 12. Since the pull ring 6 is integrally attached to the tear strip 12 at the base of the closure skirt 4 between the terminal ends 16 and 18 of the line and is of separation 14 and is larger than the diameter of the closure skirt 4, the pull ring 6 will pivot about its attachment to the tear strip 12 as illustrated in FIGS. 12, 13 and 14. Further, the attached portion of the beaded pull ring 6 will preferably cam against the exterior surface of the container mouth 50 as the pull ring 6 is lifted. Lifting the pull ring 6 stresses the unscored metal between the terminal ends 16 and 18 of the line of separation 14 and the score lines 8 and 10 to rupture or tear such metal into the score lines 8 and 10. The preferred inward and upward direction of the curved metal edges 5 in the pull ring 6 adjacent the closure skirt 4, as shown in FIG. 11, guides or directs the tearing of the mental generally tangentially into the score lines 8 and 10 along both sides of the tear strip 12. If these edges 5 in the pull ring 6 adjacent the closure skirt 4 did not curve as illustrated in the drawings, but instead were generally perpendicular to the score lines 8 and 10, the unscored metal would likely tear into the score lines 8 and 10 generally perpendicular to such score lines. The direction of tearing of the metal would then have to abruptly change to follow the score lines 8 and 10. Such abrupt change of direction of tearing is unpredictable and may sometimes fail to occur, resulting in tearing the metal across the tear strip 12 and undesirable separation of the pull ring 6 from the tear strip 12. Curvature of the terminal ends 16 and 18 of the line of separation generally inwardly during blanking of the metal disc 7 minimizes the chance of such premature separation of the tear strip 12.

Figure 15:
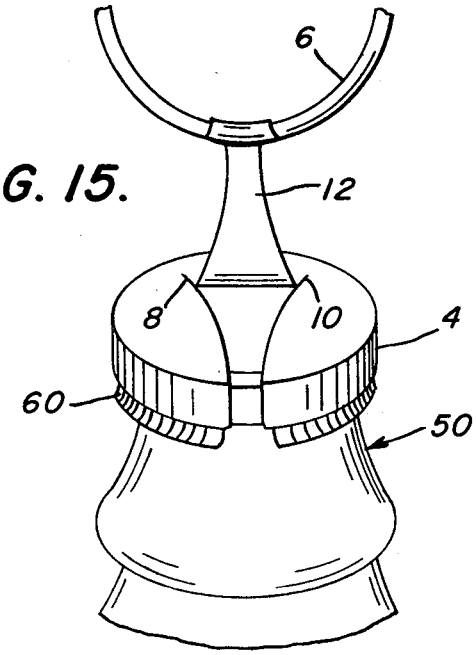
FIG. 15 is plan view showing opening of an improved tear-off closure of the present invention.

Upon rupture of the unweakened metal between the ends 16 and 18 of the line of separation 14 and the score lines 8 and 10, the pull ring 6 is attached only to the tear strip 12. Thus, when the ring 6 is pulled upwardly the score lines 8 and 10 defining the tear strip 12 control or guide the line of tearing. In this way, continued displacement of the pull ring 6 causes separation of the tear strip 12 from the closure along substantially the full length of the score lines 8 and 10 to effectively split the closure, as shown in FIG. 15. Splitting the closure relieves the circumferential stress about the bottom 60 of the closure skirt 4 so the closure can be easily lifted off the container 50 by further pulling of the ring 6.

Whereas the particular embodiments of this invention have been described above for purposes of illustration, it will be apparent to those skilled in the art that numerous variations of the details may be made without departing from the invention.

What is claimed is:

1. A tear-off closure for a container comprising a top end wall, a depending closure skirt around the top end wall and a pull ring around the bottom edge of said closure skirt, said closure having a pair of score lines therein traversing said skirt and top end wall to define a tear strip across said closure with said pull ring integrally connected to said tear strip at the bottom of said closure skirt, and a line of separation between said pull ring and said closure skirt from a location adjacent said score line on one side of said tear strip around said closure skirt to a location adjacent said score line on the other side of said tear strip, with the terminal ends of said line of separation spaced from said tear strip laterally of said score lines on both sides of said tear strip.

2. A tear-off closure as set forth in claim 1 in which the terminal ends of said line of separation are located on the closure radially inwardly of the ends of the score lines on said closure skirt.

3. A tear-off closure as set forth in claim 1 in which the terminal ends of said line of separation curve radially inwardly to locations inwardly of the terminal ends of said score lines.

4. A tear-off closure as set forth in claim 1 in which said line of separation comprises a slit line interrupted by at least one bridge of metal between the pull ring and closure skirt.

5. A sealed container comprising in combination a container body having a mouth opening defined by a crown finish, and a tear-off closure sealed over the mouth opening in said container, said closure having a top end wall, a skirt depending from the peripheral edge of the wall, the bottom edge of the closure skirt is constricted inwardly under an annular outwardly projecting bead extending around the entire periphery of the container mouth, a par of score lines therein traversing said skirt and top end wall to define a tear strip across the closure, and a pull ring around the bottom of the closure integrally attached to the tear strip and to the closure skirt by unweakened metal contiguous the score lines on both sides of the tear strip, the edge of metal in the pull ring adjacent the closure skirt are curved radially inwardly and upwardly into the unweakened metal on both sides of the tear strip.

* * * * *